US006484847B2

(12) United States Patent
Paczuski

(10) Patent No.: US 6,484,847 B2
(45) Date of Patent: Nov. 26, 2002

(54) LUBRICANT PUMP WITH MAGNETIC AND CENTRIFUGAL TRAPS

(75) Inventor: Andrew W. Paczuski, Adrian, MI (US)

(73) Assignee: Tecumseh Products Company, Tecumseh, MN (US)

( * ) Notice: Subject to any disclaimer, the term of this patent is extended or adjusted under 35 U.S.C. 154(b) by 44 days.

(21) Appl. No.: 09/727,279

(22) Filed: Nov. 30, 2000

(65) Prior Publication Data

US 2002/0063017 A1 May 30, 2002

(51) Int. Cl.[7] ..... F01M 1/10
(52) U.S. Cl. ..... 184/6.16; 184/6.25; 418/94
(58) Field of Search ..... 184/6.16, 6.17, 184/6.25; 418/94

(56) References Cited

U.S. PATENT DOCUMENTS

| | | | | |
|---|---|---|---|---|
| 2,883,101 A | | 4/1959 | Kosfeld | 230/207 |
| 3,285,504 A | | 11/1966 | Smith | 230/207 |
| 3,478,887 A | | 11/1969 | Ohrberg | 210/223 |
| 4,131,396 A | | 12/1978 | Privon et al. | 417/372 |
| 4,421,453 A | | 12/1983 | Hoff et al. | 415/88 |
| 4,432,693 A | | 2/1984 | Hackbart | 415/88 |
| 4,747,471 A | | 5/1988 | Ballentine et al. | 184/6.18 |
| 4,850,819 A | | 7/1989 | Bush et al. | 417/368 |
| 5,176,506 A | | 1/1993 | Siebel | 417/368 |
| 5,282,963 A | | 2/1994 | Hull et al. | 210/223 |
| 5,413,462 A | | 5/1995 | Alberni | 415/169.1 |
| 5,580,233 A | * | 12/1996 | Wakana et al. | 418/94 |
| 5,707,220 A | | 1/1998 | Krueger et al. | 417/423.12 |
| 5,865,607 A | | 2/1999 | Fukuoka | 418/46 |
| 6,039,550 A | * | 3/2000 | Friedley et al. | 184/6.16 |
| 6,102,160 A | * | 8/2000 | Cornelius | 184/6.16 |
| 6,116,877 A | * | 9/2000 | Takeuchi et al. | 184/6.16 |

* cited by examiner

*Primary Examiner*—Chong H. Kim
(74) *Attorney, Agent, or Firm*—Baker & Daniels

(57) ABSTRACT

A hermetic compressor assembly includes a compressor housing having a quantity of liquid lubricant therein. A compressor mechanism is provided within the compressor housing and a drive shaft is selectively rotatable and operably connected to the compressor mechanism. A liquid lubricant displacement element is engaged to the drive shaft and a support member is attached to the compressor housing. A pivotable magnetic member is provided between the liquid lubricant displacement element and the support member and includes a suction port provided therein. The liquid lubricant displacement element is in fluid communication with the quantity of liquid lubricant through the suction port in the magnetic member. At least a portion of any ferrous particles contained in the liquid lubricant are attracted to and retained by the magnetic member as the liquid lubricant is passed through the suction port of the magnetic member.

24 Claims, 6 Drawing Sheets

72'
77
74'
94'
86'
84
98
100
20
23
85
166
36
46
50
52
54
56
60
62
64
65
66
67
72
74
80
76
122
42
92
94
126
86
120
108
104
109
114
112
106

LUBRICANT PUMP WITH MAGNETIC AND CENTRIFUGAL TRAPS

BACKGROUND OF THE INVENTION

1. Field of the Invention

The present invention relates to hermetic compressors having positive displacement liquid lubricant pumps to supply liquid lubricant to bearing surfaces. More specifically, the present invention relates to compressors including liquid lubricant pumps having cavities disposed within the pump and drive shaft to trap debris by magnetic and centrifugal force.

2. Description of the Related Art

Compressor lubrication systems often include a positive displacement lubrication pump to supply liquid lubricant to bearing surfaces within the compressor. Liquid lubricant, or oil, often contains debris in the form of metallic particles circulating throughout the lubrication system. The particles detrimentally affect bearing surfaces by causing premature wear, and consequently, compressor performance is compromised. It is known to provide cartridge type or screen filters to capture debris, however an inherent disadvantage of cartridge and screen filters is that they clog and consequently block circulation of oil to bearing surfaces which significantly shortens the life of the compressor. Responsive to this clogged filter effect, compressor assemblies have been adapted with bypass valving, for example, which routes the oil around the filter when the filter becomes clogged to effectively maintain an adequate oil supply to the bearing surfaces. However, the circulating oil remains debris-laden which may cause an abrasive attack on the bearing surfaces resulting in bearing seizure and imminent failure of the compression mechanism.

Hermetic compressor assemblies are susceptible to oil-entrained debris, the most destructive being the fine powdered debris, which may not be captured by standard cartridge and filtering methods. The fine powders entrained in the oil are often composed of ferrous material which is attracted to a magnet. While previous compressor assemblies have utilized magnets to attract entrained metallic particles, these compressors have proven to do so inefficiently. Typically, magnets are randomly placed within the interior of the compressor housing, producing marginal particle accumulation performance. Therefore, the marginal benefits provided by these types of compressors, in view of the substantial costs associated with installing magnets to attract ferrous particles, have limited their practicality.

Further, with evolving and more demanding environmental standards, the hydrocarbon based oils and refrigerants traditionally used are yielding to environmental friendly substitutes. However, it is not fully understood whether these substitute lubricants are equally effective in providing comparable levels of lubrication and durability to the compressor mechanism. Thus, improving the ability to remove foreign particles from liquid lubricant, without a substantial compressor assembly cost increase, would be highly desirable.

Yet another problem associated with the use of impeller type pumps in compressor assemblies is one of drive shaft misalignment, relative to the pump housing, during the assembly process. Traditionally, misalignment of the drive shaft and pump housing was avoided by providing the pump housing, compressor mechanism assembly and impeller pump assembly with precise tolerances. A significant labor and handling cost is associated with parts having precise tolerances. What is desired is an impeller type pump assembly structure which requires significantly less labor to manufacture and assemble compared to previously employed structures.

An inexpensive oil pump assembly which includes the ability to trap debris suspended in the oil while continuously providing an ample supply of oil to bearing surfaces is highly desired. Further, an oil pump assembly which provides further cost reduction attributable to avoiding precise part tolerances in preventing drive shaft and pump housing misalignment is desired.

SUMMARY OF THE INVENTION

The present invention overcomes the disadvantages of prior compressor assemblies by providing a hermetic compressor assembly which includes a compressor housing including a quantity of liquid lubricant therein, a compressor mechanism provided within the compressor housing, a drive shaft selectively rotatable and operably connected to the compressor mechanism, a liquid lubricant displacement element engaged to the drive shaft and a support member attached to the compressor housing, a pivotable magnetic member provided between the liquid lubricant displacement element and the support member provided with a suction port therein. The liquid lubricant displacement element is in fluid communication with the quantity of liquid lubricant through the suction port in the magnetic member. At least a portion of any ferrous particles contained in the liquid lubricant are attracted to and retained by the magnetic member as the liquid lubricant is passed through the suction port of the magnetic member.

The present invention further provides a hermetic compressor assembly including a compressor mechanism and a quantity of liquid lubricant provided in a compressor housing, a selectively operable drive shaft driveably connected to the compressor mechanism, a liquid lubricant displacement element supported by a support member and engaged to the drive shaft. The compression mechanism and the liquid lubricant displacement element are in fluid communication through a passage provided in the drive shaft. A centrifugal particle trap cavity is defined by a wall of the passage within the drive shaft and a portion of the liquid lubricant displacement element. A magnetic member is pivotably supported by the support member and a thrust member is superposed with the magnetic member. A magnetic particle trap cavity is provided within a lateral face of the thrust member and is partially enclosed by a lateral surface of the magnetic member. The liquid lubricant is urged from the sump to the compression mechanism through the passage in the drive shaft and any debris in the liquid lubricant is successively retained by the magnetic particle trap cavity and the centrifugal particle trap cavity prior to the lubricants introduction to the compression mechanism.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Figure 1:
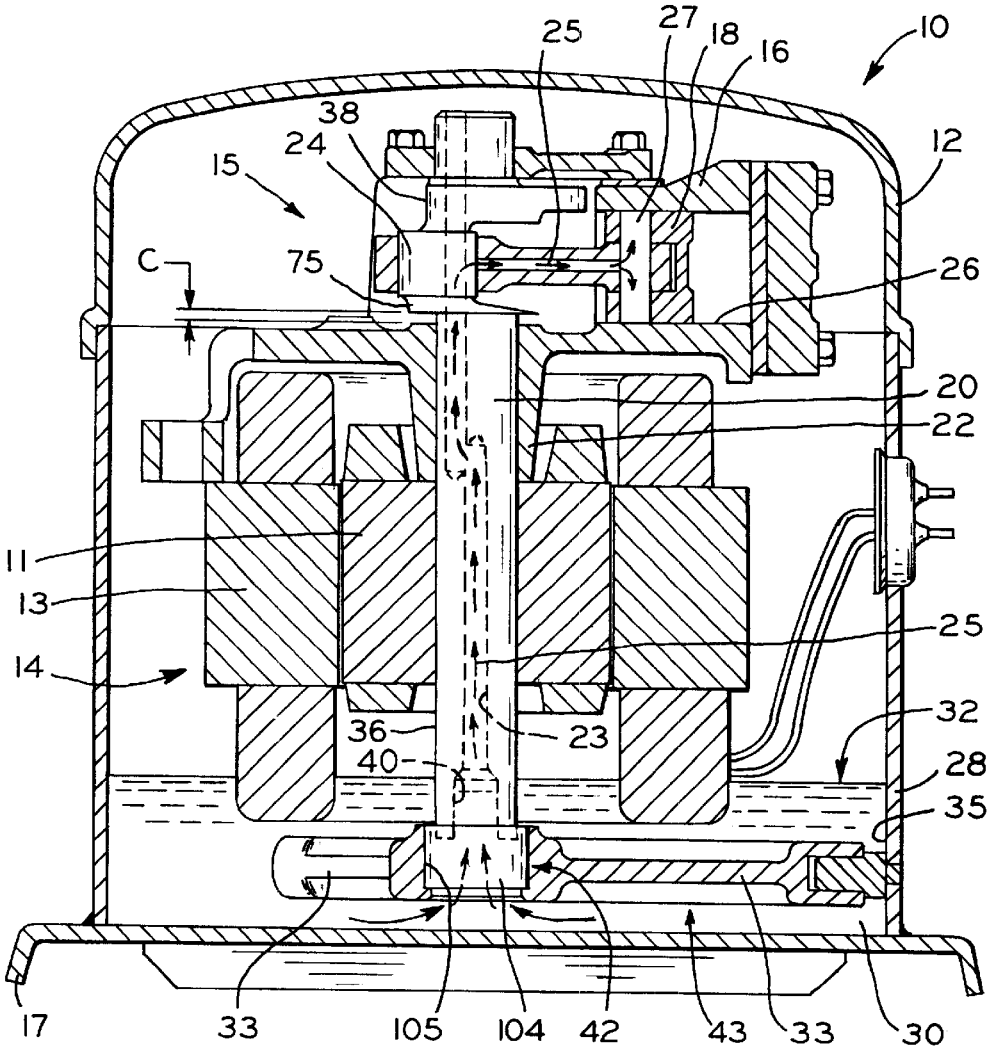
FIG. 1 is a sectional view of a hermetic compressor assembly provided with an oil pump assembly in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, and such exemplifications are not to be construed as limiting the scope of the invention in any manner.

DETAILED DESCRIPTION OF THE INVENTION

Referring to FIG. 1, compressor assembly 10 includes hermetically sealed housing 12, having base 17 provided at a lower end thereof. Motor assembly 14, enclosed within housing 12, includes rotor 11 and stator 13 and is directly connected to, and operatively drives, compression mechanism 15. Compression mechanism 15 may constitute a reciprocating piston-type compression mechanism, as shown, which includes cylinder block 16 having reciprocating piston 18 therein. Alternatively, compression mechanism 15 may be a rotary or scroll type mechanism. Drive shaft or crankshaft 20is driveably coupled to motor assembly 14 and extends vertically from a lowermost portion of compressor assembly 10 upwardly towards compression mechanism 15. Upper end of crankshaft 20 is rotatably supported by main bearing 22 and is generally hollow, including inner passage 23 extending axially, and continuously, along the length of crankshaft 20. Arrows 25 illustrate flow of liquid lubricant (e.g., oil), which is directed through passage 23 of crankshaft 20, to supply oil to bearing surfaces, such as rod bearing 24, and to wrist pin 27, as shown. Oil pump assembly 42 is positioned at lower end 36 of crankshaft 20 to urge oil from oil sump 30 to upper end 38 of crankshaft 20. Support member 43, provided within lower portion 28 of housing 12 to support pump 42, includes a plurality of arms 33 equidistantly spaced and radially extended between pump 42 and inner surface 35 of housing 12. Oil sump 30, formed by lower portion 28 of housing 12, contains surplus oil to supply pump assembly 42 with oil. Oil level 32 within sump 30 is preferably maintained above oil pump assembly 42, as shown, such that a continuous supply of oil is pumped to bearing surfaces by pump assembly 42.

Figures 2A, 2B:
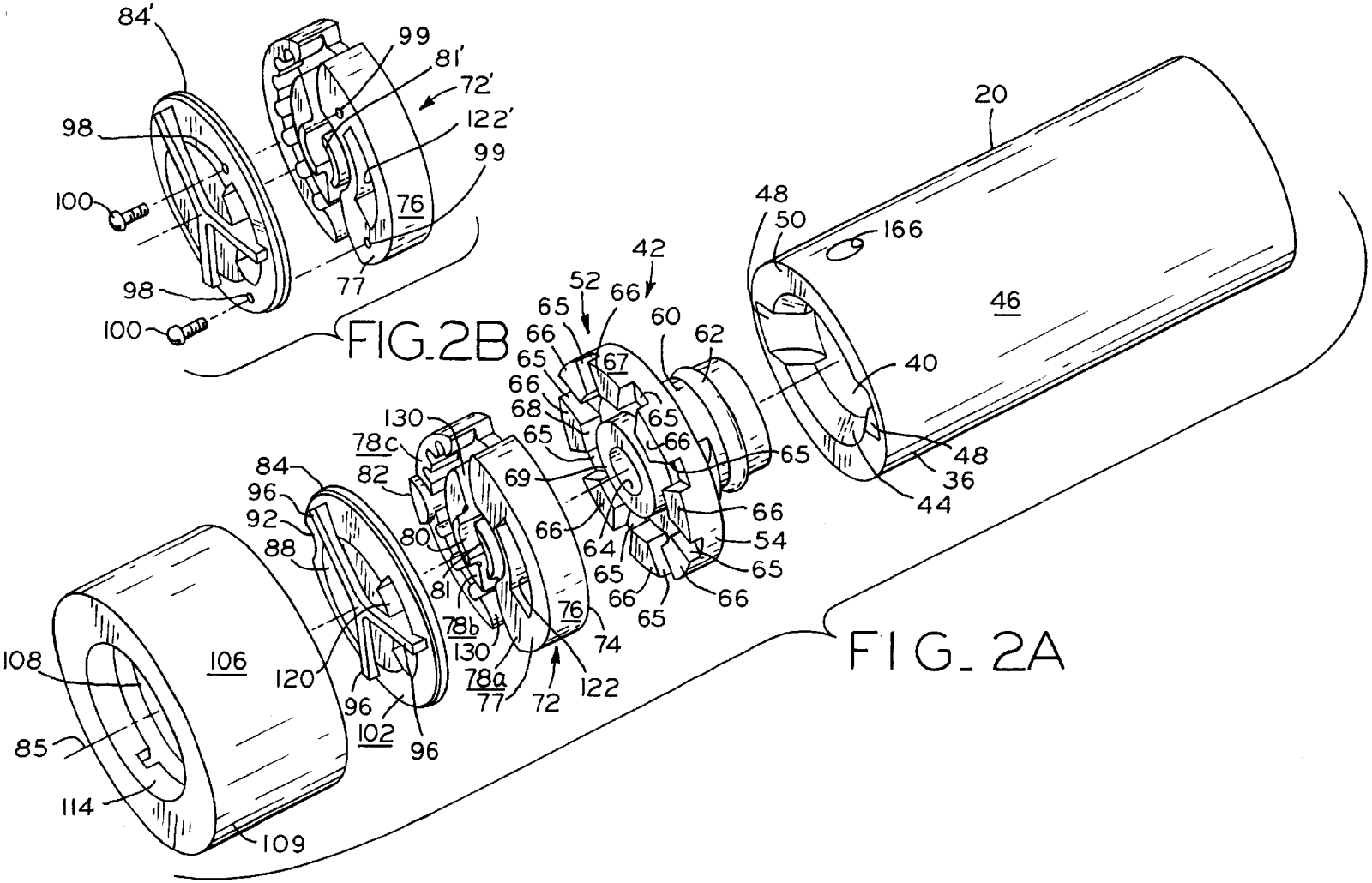
FIG. 2A is an exploded view of a first embodiment of an oil pump assembly in accordance with the present invention, viewing the pump from the bottom.
FIG. 2B is an exploded view of the thrust plate and magnetic disk assembly of a second embodiment of an oil pump assembly in accordance with the present invention, viewing the assembly from the bottom.
Figures 3A, 3B:
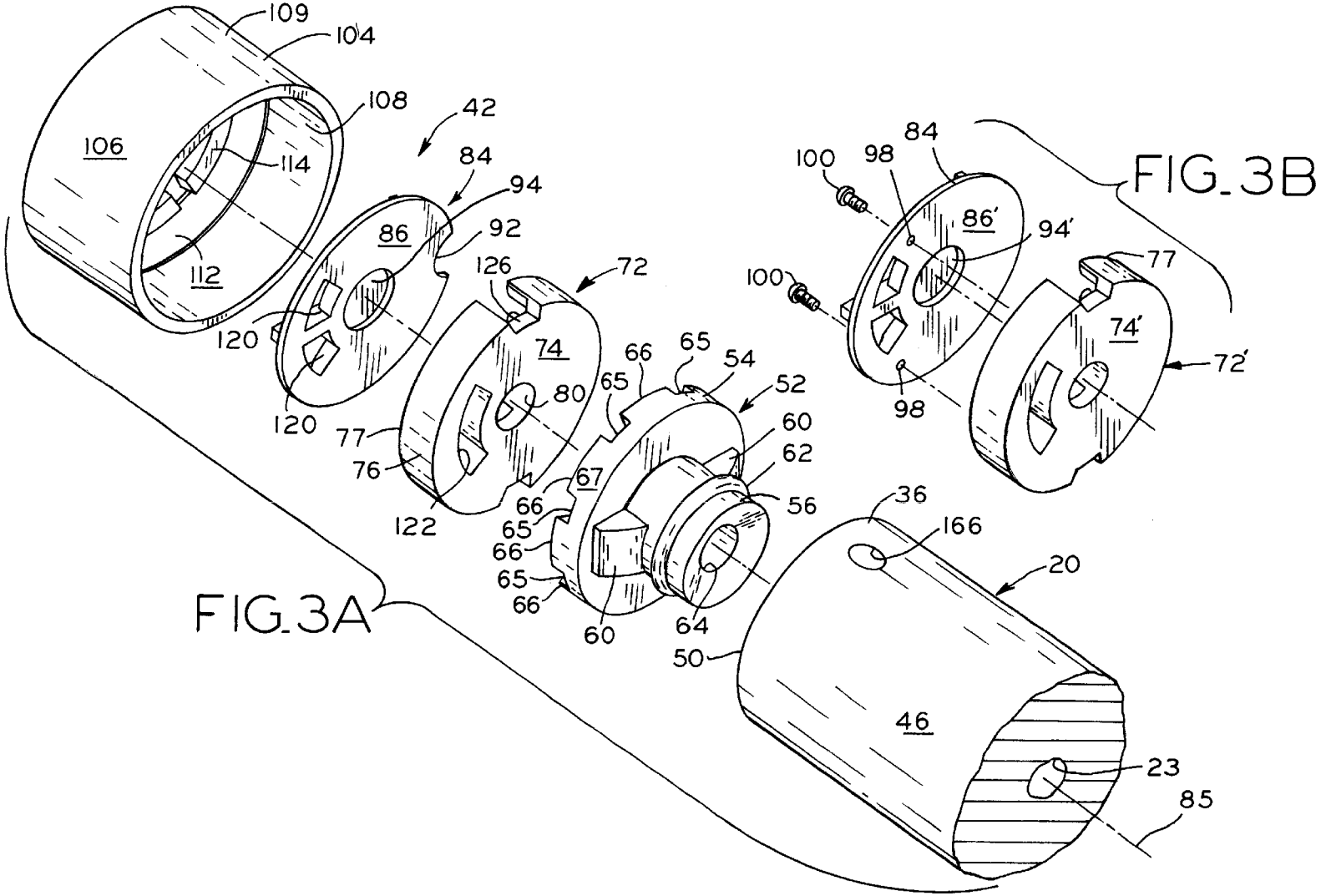
FIG. 3A is an exploded view of the oil pump assembly of FIG. 2A, viewing the pump from the top.
FIG. 3B is an exploded view of the thrust plate and magnetic disk assembly of FIG. 2B, viewing the assembly from the top.

Referring to FIGS. 2A and 3A, shown is oil pump assembly 42, engaged with lower end 36 of crankshaft 20. Lower end 36 of crankshaft 20 includes end face 50 and outer surface 46. Lower end 36 of crankshaft is attached to oil displacement element or impeller 52. Alternatively, oil displacement element 52 may include a gerotor or gear type element to transfer oil from sump 30 to compression mechanism 15 (FIG. 1). It may be seen that counterbore 40 (FIG. 2A) is formed in lower end 36 of crankshaft 20 to receive stem 56 of impeller 52. End face 50 of crankshaft 20 includes angled counterbore or chamfer 44 provided in counterbore 40 of crankshaft 20 (FIG. 2A). A pair of diametrically opposed slots 48 (FIG. 2A) radially extend from counterbore 40 of crankshaft 20 toward outer surface 46 of crankshaft 20 to engageably receive tangs 60 of impeller 52. Tangs 60 axially extend from disk shaped drive portion 54 and are attached to a periphery of impeller stem 56 (FIG. 3A).

Figure 4:
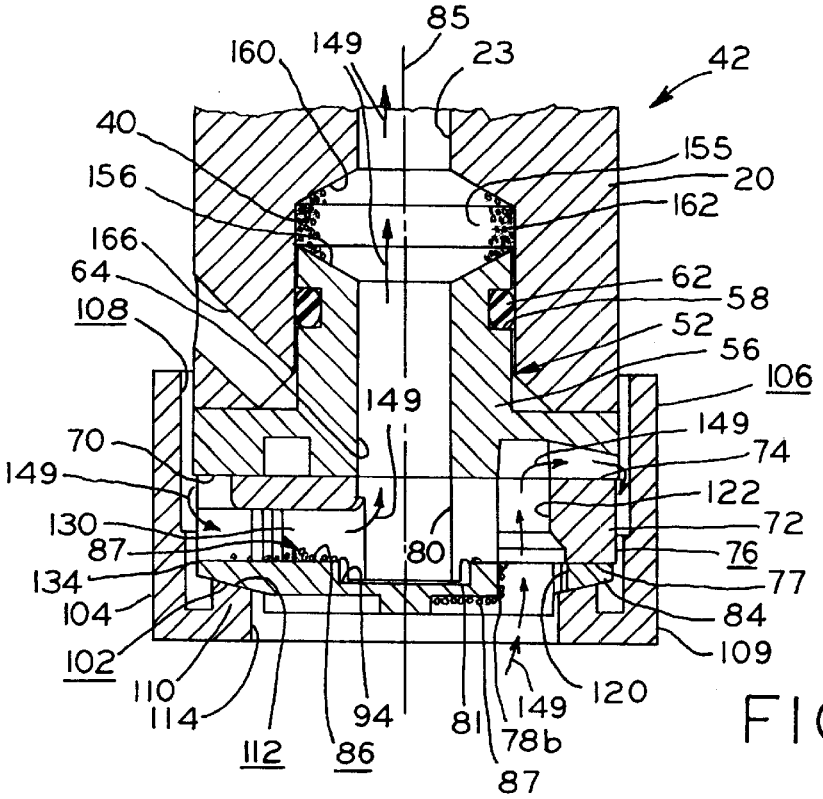
FIG. 4 is a sectional view of the oil pump assembly taken along line 4—4 of FIG. 11, however shown in an operational mode, illustrating a flow of oil therethrough and particles being trapped in respective magnetic and centrifugal traps.
Figure 5:
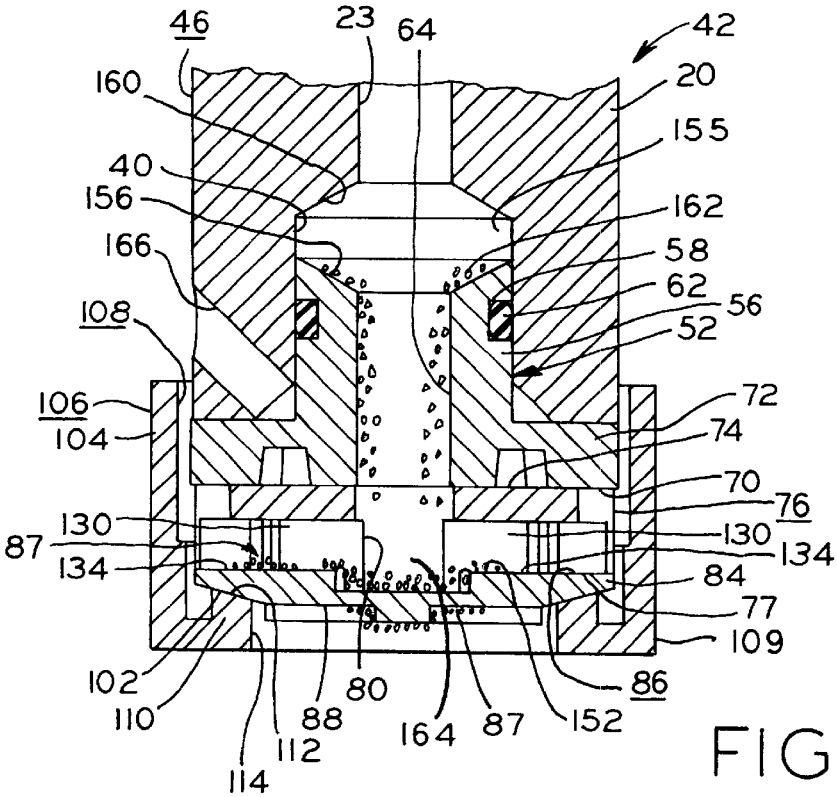
FIG. 5 is a sectional view of the oil pump assembly taken along lines 5—5 of FIG. 11, however shown in a non-operational mode.
Figure 6:
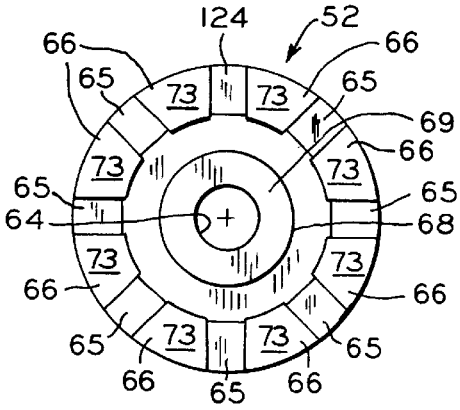
FIG. 6 is a plan view of the bottom of the impeller of the oil pump of FIG. 2A, showing the plurality of impeller blades.

Impeller stem 56 axially extends from drive portion 54 and includes circumferentially disposed groove 58 (FIGS. 4 and 5), having a U-shaped cross section and O-ring 62 is received therein. O-ring 62 provides a liquid seal between the outer periphery of impeller stem 56 and counterbore 40 of drive shaft 20 (FIGS. 4 and 5). Drive portion 54 of impeller 52 includes a plurality of radially arranged impeller blades 66. Each impeller blade 66 is separated from an adjacent impeller blade 66 by circumferential spaced groove 65 (FIG. 6). As best seen in FIGS. 2A and 6, impeller 52 includes annular groove 68 located substantially centered on lower surface of drive portion 54 of impeller 52. Impeller 52 includes center portion 69 provided with generally planar surface 71 which is coextensive with surface 73 of each respective impeller blade 66 (FIG. 6). Hole 64 extends axially through impeller 52. Surfaces 71 and 73 form thrust face 70 (FIGS. 4–5) of impeller 52.

Referring again to FIGS. 2A and 3A, shown is thrust member or thrust plate 72 having thrust face 74 which rotatably supports thrust face 70 of impeller 52 (FIGS. 4–5). It may be seen that a clearance "c" exists between main bearing 22 and shoulder portion 75 of crankshaft 20 such that the weight of crankshaft 20 and displacement element 52 urges displacement element 52 into engagement with face 74 of thrust plate 72 (FIG. 1). Those having ordinary skill will understand that the combined weight of crankshaft 20, and displacement element 52, bearing down on face 74 of thrust plate 72 prevents a significant and detrimental loss of lubricant through an interface provided by displacement element 52 and face 74 of thrust plate 72.

Figure 7:
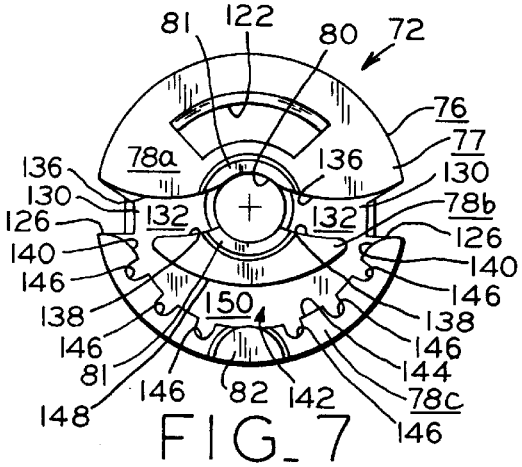
FIG. 7 is a plan view of the bottom of the thrust plate of the oil pump of FIG. 2A, showing the pair of arcuate slots and the magnetic particle trap cavity.

Thrust plate 72 includes outer radial surface 76 and lateral surface 77 (FIG. 7). Lateral surface 77 is provided with lower faces 78*a*, 78*b* and 78*c* which collectively form a planar support surface which abuts upper face 86 of magnetic member or disk 84 (FIGS. 2A and 7). Thrust plate 72 is provided with central hole 80 which is aligned with central hole 64 of impeller 52 (FIGS. 4 and 5). As best seen in FIGS. 2A and 4, thrust plate 72 includes extended annular nose portion 81, split into two arcuate halves, each of which axially extend from lower face 78*b*. The two halves of nose portion 81 are engaged with recess 94 in magnetic disk 84 to center thrust plate 72 relative to magnetic disk 84 (FIG. 3A).

Figure 8:
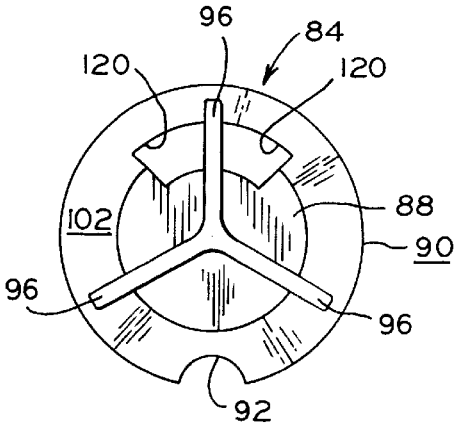
FIG. 8 is a plan view of the bottom of the magnetic disk of the oil pump of FIG. 2A.
Figure 9:
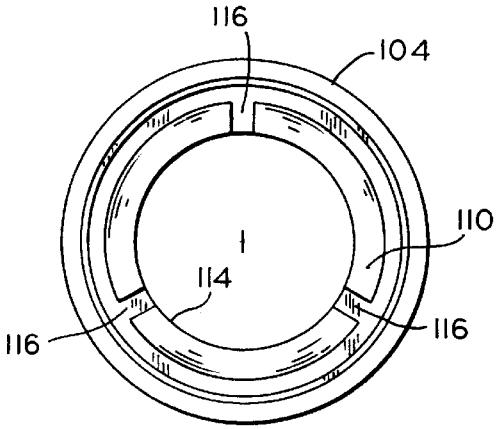
FIG. 9 is a plan view of the top of the pump housing of the oil pump of FIG. 3A.
Figure 11:
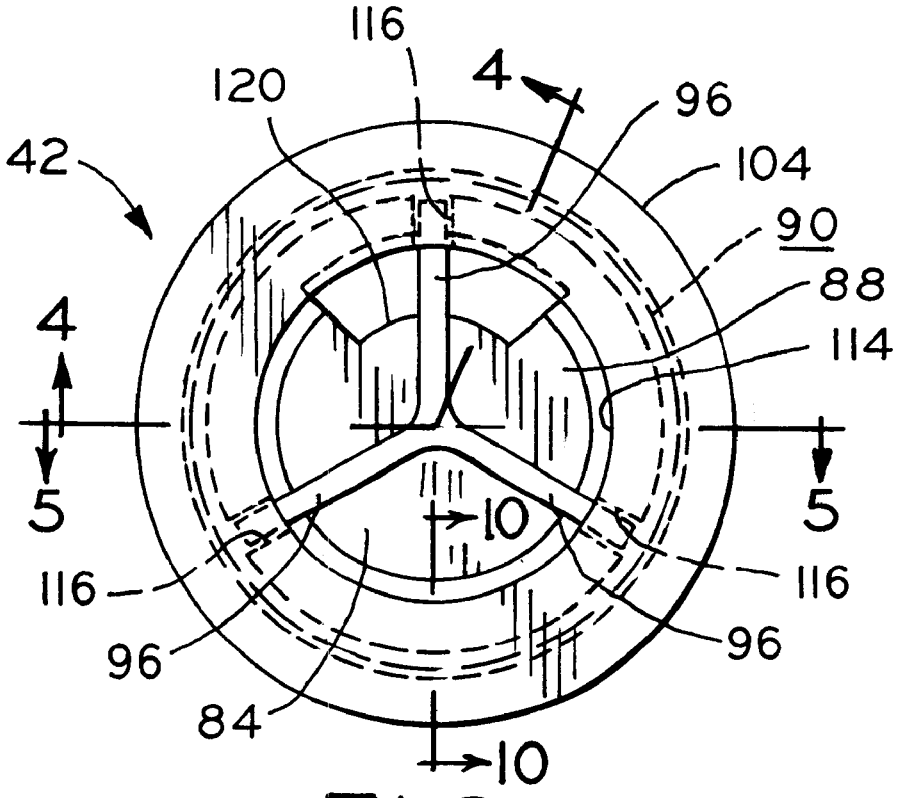
FIG. 11 is a bottom view of the oil pump assembly of FIG. 2A.

Magnetic disk 84 includes upper face 86, lower face 88 and peripheral surface 90, and as best seen in FIGS. 3A and 8, is provided with semi-circular notch 92 which receives semi-circular protrusion 82 (FIG. 7) axially extended from thrust plate 72. Protrusion 82, extended into notch 92, prevents rotation between magnetic disk 84 relative to thrust plate 72. Lower face 88 of magnetic disk 84 includes three projections 96 intersected at centerline axis 85 and radially extended towards peripheral surface 90 of magnetic disk 84 (FIGS. 2A and 11). Referring to FIG. 11, radial projections 96 are engaged with three circumferentially spaced slots 116 (FIG. 9) located in pump housing 104 to prevent rotation between magnetic disk 84 and pump housing 104. Housing 104 is fixed to support member 43 by, for example, a press fit engagement between outer surface 106 of housing 104 and counterbore 105 located in support member 43 (FIG. 1). Alternatively housing 104 may be eliminated and in its place support member 43 may be provided with identically internal characteristics as that of housing 104.

Magnetic disk 84 may be manufactured from a magnetized metallic material through, for example, a sinterized powder metal process. The magnetic properties of magnetic disk 84 attract ferrous particles 87 (FIG. 4) entrained or suspended in the oil as described below. Impeller 52 and thrust plate 72 may be made of an abrasion resistant moldable plastic, such as a phenolic material for example, through an injection molding process. Crankshaft 20 may be preferably made from a carbon steel and formed through a forging process to produce high durability and abrasion resistant properties.

An alternate thrust plate and magnetic disk engagement is shown in FIGS. 2B and 3B. As best seen in FIG. 2B, magnetic disk 84' includes a pair of through holes 98 aligned with a pair of holes 99 in thrust plate 72'. Holes 99 are engaged by a pair of fasteners 100, which may include, for example, brads, to secure magnetic disk 84' to thrust plate 72'.

Figure 10A:
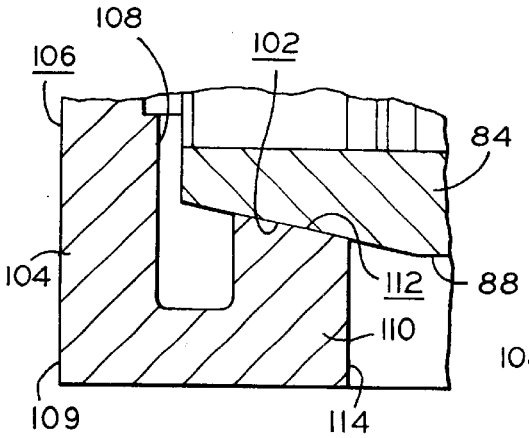
FIG. 10A is a fragmentary sectional view of the oil pump assembly according to the present invention enclosed within the circular portion shown as line 10A—10A of FIG. 11, showing the engagement between the frustoconical surfaces of the pump housing and magnetic disk.

Referring to FIGS. 2–5, pump housing 104 is provided with cylindrical outer surface 106 and cylindrical inner surface 108 (FIGS. 3–5). Housing 104 and support member 43 may be made from an aluminum alloy through a die cast molding process or a powder metal process, for example. As best seen in FIG. 10A, lower end 109 of housing 104 includes annular platform 110 which provides support for magnetic disk 84. Platform 110 includes inwardly angled frustoconical surface 112 providing support for outwardly angled frustoconical surface 102 (FIG. 8) provided on lower face 88 of magnetic disk 84 (FIGS. 4, 5 and 10). Lower end 109 of housing 104 includes through hole 114 extended axially through housing 104 to provide an inlet for oil to be drawn into pump 42 by the oil displacement element, i.e. impeller 52. Frustoconical surface 112, provided on annular platform 110, forms a frustoconical engagement with frustoconical surface 102 of magnetic disk 84. The frustoconical engagement provides a degree of self alignment of the abutting faces of impeller 52 and thrust plate 72, despite angular variations in the housing centerline relative to the shaft centerline. As a result, reliance on close manufacturing and assembling tolerances of impeller 52, crankshaft 20 and thrust plate 72, traditionally employed, are not required with oil pump 42.

Figure 10B:
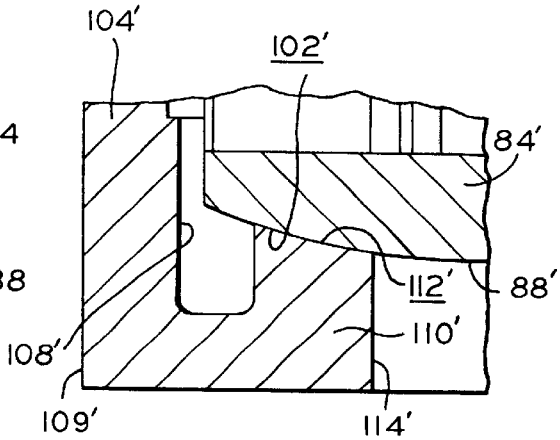
FIG. 10B is a fragmentary sectional view of a third embodiment of the oil pump assembly according to the present invention showing the engagement between the spherical surfaces of the pump housing and magnetic disk.

Referring to FIG. 10B, a third embodiment of a lubricant pump is shown and includes mating hemispherically shaped surfaces 102', 112' of magnetic member and housing 104', 84' respectively. As an alternative to frustoconical surfaces 102, 112 shown, in FIG. 10A, hemispherical surfaces 102', 112' shown in FIG. 10B provide increased pivoting mobility between magnetic member 84' relative to housing 104' to remedy the angular variations in the housing centerline relative to the shaft centerline.

The flow of oil through oil pump assembly 42 will now be described. Referring to FIG. 4, oil is drawn through suction port or hole 114 of housing 104 from sump 30 and into a pair of arcuate suction ports 120 formed in magnetic disk 84 (FIGS. 4, 8 and 11). Arcuate suction ports 120 extend completely through the magnetic disk from lower face 88 to upper face 86 (FIG. 8). Similarly, arcuate suction port 122 extends completely through thrust plate 72 between thrust face 74 and lower face 78*a* thereof (FIG. 7). Arcuate suction port 122, provided in thrust plate 72, is radially aligned with the, pair of arcuate suction ports 120 in magnetic disk 84. It may be seen that thrust plate 72 includes a pair of U-shaped discharge slots 126 provided in outer periphery 76 of thrust plate 72 (FIG. 3A). Slots 126 are oppositely located relative to one another and axially extend into a pair of arcuate channels 130 formed in thrust plate 72 (FIGS. 2A, 7). Channels 130 are provided in lateral surface 77 of thrust plate 72 as described below.

As best seen in FIG. 7, each channel 130 includes transverse wall 132, first sidewall 136, and second sidewall 138. Transverse wall 132 is substantially planar and is formed within lateral surface 77 of thrust plate 72. First sidewall 136 is arcuate and extends from its respective discharge slot 126 to hole 80 in thrust plate 72. Each second side wall 138 of channel 130 includes U-shaped slot 140. A portion of oil received by slots 126 from impeller 52 flows into channels 130 and into central hole 80 in thrust plate 72. The other portion of oil flows into magnetic particle trap cavity 142 as described below.

Lateral surface 77 of thrust plate 72 is provided with crescent-shaped magnetic particle trap cavity 142. First sidewall 144 of magnetic particle trap cavity 142 includes a plurality of circumferentially spaced semi-circular inclusions 146 (FIG. 7). Second sidewall 148 of magnetic particle trap cavity 142 is generally smooth and continuous. Magnetic particle trap cavity 142 includes transverse wall 150 provided in lateral surface 77 of thrust plate 72. Magnetic particle trap cavity 142 is enclosed by upper face 86 of magnetic disk 84 (FIGS. 4 and 5).

In operation, pump 42 is activated by motor driven shaft 20 urging rotation of impeller 52 and oil in sump 30 (FIG. 1) is drawn, illustrated by arrows 149 in FIG. 4, into suction port 120 of magnetic disk 84. Thereafter, oil enters suction port 122 provided in thrust plate 72. It is well understood that over time a compressor assembly generates debris which becomes entrained in the oil and frequently a portion of the debris is in the form of ferrous particles. Ferrous particles, which may be included in the present invention lubricant pump 42, are attracted to and retained by magnetic disk 84 before the oil enters suction port 122 of thrust plate 72. Oil then enters annular groove 68 within impeller 52 and is centrifugally flung radially outward through radially positioned grooves 65 between impeller blades 66. The oil is then urged downwardly into U-shaped discharge slots 126 in thrust plate 72, and thereafter, a portion of the oil is urged into the pair of arcuate channels 130 which extend toward central hole 80 of the thrust plate 72. Oil entering central hole 80 of thrust plate 72 via channels 130 is urged upwardly through hole 64 in impeller 52, into passage 23 of crankshaft 20, and is ultimately received by the bearing surfaces within the compressor mechanism.

The portion of oil which does not travel through arcuate slots 130 enters magnetic particle trap cavity 142 and is slow moving due to the debris entrained therein. The oil entering magnetic particle trap cavity 142 is flung radially outward into the plurality of inclusions 146 in first sidewall 144. Oil circulates through magnetic particle trap cavity 142, entering one of the U-shaped slots 140 and exiting the other U-shaped slot 140. Since thrust plate 72 is symmetrical, pump 42 may operate in either rotational direction with similar particle trapping results, i.e., pump 42 is reversible.

Referring to FIGS. 4 and 5, it may be seen that upper face 86 of magnetic disk 84 overlays arcuate channels 130 and magnetic particle trap cavity 142 of thrust plate 72. Ferrous particles 87 entering magnetic particle trap cavity 142 are carried with the oil and are attracted to and trapped by upper face 86 of magnetic disk 84 under the influence of magnetic force established by magnetic disk 84 (FIG. 4). Additionally, oil flowing through channels 130 includes ferrous particles which pass over magnetic disk 84 and become attracted and attached to face 86 of magnetic disk. Additional particles and debris, which may include ferrous or non-ferrous particles, are caught within inclusions 146 of magnetic particle trap cavity 142 as oil flows through cavity 142. Therefore, magnetic particle trap cavity 142 and face 86 of magnetic disk 84 provide a two-stage debris retaining structure, the first stage provided by inclusions 146 within thrust plate 72, trapping a portion of the debris therein, and a second stage, provided by face 86 of magnetic disk 84, trapping additional debris, in the form of ferrous particles 87.

As best seen in FIG. 4, drive shaft 20 is provided with centrifugal particle trap cavity 155 radially located within a wall defining passage 23. Specifically, centrifugal particle trap cavity 155 is bound by counterbore 40 and frustoconical surface 156 of impeller stem 56, on one axial end, and frustoconical surface 160 of the other axial end. Thus, it may be seen that annular, frustoconical surfaces 156, 160, and a portion of counterbore 40 in crankshaft 20, form centrifugal particle trap cavity 155 to capture debris 162, as it is transported by the oil flowing through passage 23, shown by flow arrow 149 (FIG. 4). Particles 162, under the influence of centrifugal force as crankshaft 20 is rotated by motor assembly 14, are flung into centrifugal particle trap cavity 155 as oil moves through passage 23. Particles 162 are thereby centrifugally trapped in centrifugal particle trap cavity 155 during compressor operation, and are prevented from thereafter continuing with the oil upwards through passage 23.

Referring to FIG. 5, it may be seen that once shaft 20 ceases rotation, at least a portion of particles 162 travel downwardly and rest upon conical surface 156 formed by impeller stem 56. The remaining particles continue downwardly from second chamber 155 and accumulate at center portion 164 of magnetic disk 84 and some particles may eventually flush back through oil pump 42 and into oil sump 30 or magnetic particle trap cavity 142. Those having ordinary skill in the art will understand that an abundance of debris entrained in the oil will not plug inventive pump 42. Rather, magnetic and centrifugal particle trap cavities 142, 155 are so positioned within the oil circuit such that oil is allowed to pass through pump 42 regardless of whether the magnetic and centrifugal particle trap cavities are replete with debris. Since hermetically sealed compressor assembly 10 of the present invention is manufactured to be non-maintainable, i.e., not to be disassembled for maintenance purposes, it is particularly important that oil pump 42 continues to perform even if a significant amount of debris is accumulated within magnetic and centrifugal particle trap cavities 142, 155.

Referring to FIGS. 2–5, gas vent 166 extends from chamfer 44 of crankshaft 20 to outer surface 46 of crankshaft 20 to provide an escape path for refrigerant gases flashed from the oil in pump 42. Gases or vapor which are not vented may be detrimental to proper lubricant flow, inasmuch as it may cause an insufficient amount of oil being delivered to the bearing surfaces. Vent 166 provides an escape for these gases to avoid bearing damage.

While this invention has been described as having exemplary designs, the present invention may be further modified within the spirit and scope of this disclosure. Therefore, this application is intended to cover any variations, uses, or adaptations of the invention using its general principles. For example, aspects of the present invention may be applied to compressors other than reciprocating piston compressors such as rotary and scroll compressor assemblies, for example. Further, this application is intended to cover such departures from the present disclosure as come within known or customary practice in the art to which this invention pertains.

What is claimed is:

1. A hermetic compressor assembly comprising:

a compressor housing including a quantity of liquid lubricant therein;

a compressor mechanism disposed in said compressor housing;

a drive shaft selectively rotatable and operably connected to said compressor mechanism; and a liquid lubricant displacement element engaged to said drive shaft;

a support member attached to said compressor housing;

a pivoting magnetic member disposed between said liquid lubricant displacement element and said support member;

a suction port defined within said magnetic member, said liquid lubricant displacement element is in fluid communication with said quantity of liquid lubricant through said suction port in said magnetic member, wherein at least a portion of any ferrous particles contained in said liquid lubricant are attracted to and retained by said magnetic member as said liquid lubricant is passed through said suction port of said magnetic member.

2. The compressor assembly according to claim 1, further comprising a thrust member, said liquid lubricant displacement element being supported by said thrust member.

3. A hermetic compressor assembly comprising:

a compressor housing including a quantity of liquid lubricant therein;

a compressor mechanism disposed in said compressor housing;

a drive shaft selectively rotatable and operably connected to said compressor mechanism; and a liquid lubricant displacement element engaged to said drive shaft;

a support member attached to said compressor housing;

a pivotable magnetic member disposed between said liquid lubricant displacement element and said support member;

a suction port defined within said magnetic member, said liquid lubricant displacement element is in fluid communication with said quantity of liquid lubricant through said suction port in said magnetic member; and a thrust member, said liquid lubricant displacement element being supported by said thrust member;

wherein at least a portion of any ferrous particles contained in said liquid lubricant are attracted to and retained by said magnetic member as said liquid lubricant is passed through said suction port of said magnetic member and said thrust member defines a magnetic particle trap cavity, said magnetic particle trap cavity being superposed by said magnetic member, whereby an additional portion of said any ferrous particles contained in said liquid lubricant is retained within said magnetic particle trap cavity under the influence of magnetic force.

4. The compressor assembly according to claim 3, wherein said magnetic particle trap cavity includes a plurality of circumferentially disposed inclusions, whereby any debris contained by said liquid lubricant is captured within said inclusions as said liquid lubricant is passed through said magnetic particle trap cavity.

5. The compressor assembly according to claim 1, wherein said drive shaft includes a passage, said passage partially defining a centrifugal particle trap cavity, wherein at least a portion of any debris contained in said liquid lubricant is retained within said centrifugal particle trap cavity under the influence of centrifugal force provided by rotation of said drive shaft.

6. The compressor assembly according to claim 5, wherein said liquid lubricant displacement element is in fluid communication with an exterior portion of said drive shaft through a gas vent disposed in said drive shaft and any gas intermixed with said liquid lubricant is transported to an interior of said compressor housing through said gas vent.

7. The compressor assembly according to claim 5, wherein said centrifugal particle trap cavity is located downstream of said magnetic particle trap cavity.

8. The compressor assembly according to claim 3, wherein said thrust member includes a lateral face having a pair of radially extended channels disposed therein, said magnetic particle trap cavity being disposed in said lateral face of said thrust member, wherein said liquid lubricant being urged toward said lateral face of said thrust member is diverted between said channels and said magnetic particle trap cavity.

9. The compressor assembly according to claim 2, wherein said thrust member is supported by a lateral surface of said magnetic member, said magnetic member comprising a magnetized substance to attract and retain any ferrous particles contained in said liquid lubricant.

10. The compressor assembly according to claim 1, wherein said liquid lubricant displacement element is an impeller.

11. A hermetic compressor assembly comprising:

compressor housing including a quantity of liquid lubricant therein;

a compressor mechanism disposed in said compressor housing;

a selectively operable drive shaft driveably connected to said compressor mechanism;

a support member;

a liquid lubricant displacement element supported by said support member, said liquid lubricant displacement element engaged to said drive shaft, said compressor mechanism and said liquid lubricant displacement element being in fluid communication through a passage disposed in said drive shaft;

a centrifugal particle trap cavity defined by a wall of said passage within said drive shaft and a portion of said liquid lubricant displacement element;

a magnetic member pivotably supported by said support member;

a thrust member superposed with said magnetic member; and a magnetic particle trap cavity disposed within a lateral face of said thrust member and being partially enclosed by a lateral surface of said magnetic member, wherein said liquid lubricant is urged from said sump to said compression mechanism through said passage in said drive shaft and any debris in said liquid lubricant being successively retained by said magnetic particle trap cavity and said centrifugal particle trap cavity.

12. The compressor assembly according to claim 11, wherein said magnetic particle trap cavity is partially defined by a plurality of radially disposed inclusions, wherein any debris contained in said liquid lubricant is retained by said centrifugal particle trap cavity under the influence of centrifugal force and any debris comprising ferrous particles is retained by said magnetic particle trap cavity under the influence of magnetic force.

13. The compressor assembly according to claim 11, wherein said magnetic particle trap cavity is positioned upstream relative to said centrifugal particle trap cavity.

14. The compressor assembly according to claim 11, wherein said magnetic member is pivotally supported within said housing;

15. The compressor assembly according to claim 11, wherein said magnetic member includes a surface moveably engaged with a surface defined by said pump housing.

16. The compressor assembly according to claim 15, wherein said surface of said magnetic member and said surface of said support member are superposed spherical surfaces.

17. The compressor assembly according to claim 15, wherein said surface of said magnetic member and said surface of said support member are superposed frustoconical surfaces.

18. The compressor assembly according to claim 11, wherein said liquid lubricant displacement element is in fluid communication with an interior of said compressor housing through a gas vent disposed in said drive shaft.

19. The compressor assembly according to claim 11, further comprising a pump housing disposed between said support member and said magnetic member.

20. The compressor assembly according to claim 11, wherein said liquid lubricant displacement element constitutes an impeller.

21. The compressor assembly according to claim 20, wherein said compressor housing defines a liquid lubricant sump containing said liquid lubricant, said impeller includes an annular groove disposed therein, said annular groove being in fluid communication with said sump through a suction port extended axially through said thrust member and said magnetic member.

22. The compressor assembly according to claim 21, wherein said suction port extended through said thrust member and said magnetic member is offset relative to a centerline extended axially through said drive shaft.

23. The compressor assembly according to claim 22, wherein said compressor mechanism includes bearing surfaces in fluid communication with said liquid lubricant displacement element though said passage within said drive shaft, said liquid lubricant displacement element and said thrust member include a centrally located discharge port axially extended therethrough, said suction port within said magnetic member and said thrust member in fluid communication with said discharge port within said liquid lubricant displacement element and said thrust member through a pair of slots disposed in said thrust member.

24. The compressor assembly according to claim 11, wherein said magnetic member comprises a disk having a pair of lateral surfaces, one of said pair of lateral surfaces includes a plurality of radially extending projections attached thereto, said projections being received within a plurality of circumferentially spaced and radially extended slots provided in said support member, whereby said magnetic member is substantially rotationally restrained relative to said pump housing.

* * * * *